United States Patent [19]

Ohno et al.

[11] Patent Number: 4,646,679

[45] Date of Patent: Mar. 3, 1987

[54] DEVELOPING APPARATUS

[75] Inventors: Akio Ohno, Tokyo; Kiyoharu Tanaka, Yokohama; Kenji Takeda, Yokohama; Kenji Yoshinaga, Yokohama; Shinichi Oguri, Yokohama; Yusaku Takada, Tokyo, all of Japan

[73] Assignee: Canon Kabushiki Kaisha, Tokyo, Japan

[21] Appl. No.: 738,236

[22] Filed: May 28, 1985

[30] Foreign Application Priority Data

Jun. 1, 1984 [JP] Japan ..... 59-113621

[51] Int. Cl.[4] ..... B05C 11/00

[52] U.S. Cl. ..... 118/691; 118/645

[58] Field of Search ..... 118/691, 645

[56] References Cited

U.S. PATENT DOCUMENTS 3,987,756 10/1976 Katayama et al. ..... 118/645
4,030,445 6/1977 Takenaga et al. ..... 118/645
4,241,696 12/1980 Huzii ..... 118/691
4,389,972 6/1983 Kirakura et al. ..... 118/691
4,451,135 5/1984 Okumura et al. ..... 118/691 X
4,536,080 8/1985 Hauser et al. ..... 118/691 X

*Primary Examiner*—Bernard D. Pianalto
*Attorney, Agent, or Firm*—Fitzpatrick, Cella, Harper & Scinto

[57] ABSTRACT

A plurality of developing devices or units are supported on a supporting member or turret which is rotatable to revolve the developing devices to move a desired developing device to a developing station where the developing operation is effected with the desired one of the developing devices. The developing devices are each provided with detecting elements for detecting the remaining amount of the developer or the concentration of the developer. The detecting elements are located at such a position that during the rotation of the supporting member the developer particles move with the rotation of the supporting member so that the detecting element is constantly cleaned by the moving developer.

13 Claims, 7 Drawing Figures

DEVELOPING APPARATUS

BACKGROUND OF THE INVENTION

The present invention relates to a developing apparatus usable with an image forming apparatus wherein a multi-color image or a full-color image is formed by an electrophotographic process, an electrostatic recording process, a magnetic recording process or the like.

In the field of electrophotography, many proposals have been made to form multi-color, e.g., two color image or a full-color image, wherein the apparatus is required to have a plurality of developing devices. In order to provide a full-color image, in a copying apparatus, for example, one developing device is required for each of yellow toner, magenta toner, cyan toner and black toner, if required, so as to develop a latent image corresponding to each of the color-separated images. As for a method of arranging the developing devices around a photosensitive member, they are all located around the photosensitive member along its surface. Further, Japanese Patent Application Publication No. 20579/1980 filed by the assignee of this application proposes that a plurality of developing devices are fixedly supported on a revolvable supporting turret so that the developing openings of the developing devices are selectively opposed to the surface of the photosensitive member by revolving the turret. The latter is advantageous in that only one developing device is opposed to the photosensitive member with the result that the circumferential length of the photosensitive member measured along the direction of its movement can be reduced so as to reduce the size of the whole apparatus.

Generally, the developing device is required to have detecting means therein in order to detect the amount of the toner therewithin and the mixture ratio of the toner and carrier. However, the detection may be erroneous when the toner is attached to the sensing surface of the detecting means. It is necessary to provide a member for cleaning the sensing surface of the detecting means to remove the toner therefrom. When such a member is used, a driving mechanism for the cleaning member is required. However, in the device described above wherein the plurality of the developing devices are supported on a revolvable turret so as to oppose a required one of them to the photosensitive member, the cleaning member and the associated driving mechanism results in a much complicated structure.

SUMMARY OF THE INVENTION

Accordingly, it is a principal object of the present invention to provide a developing apparatus wherein the attachment of the developer to the detecting means is efficiently prevented so as to make possible correct detection of the state of the developer.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiments of the present invention will be described in detail in conjunction with the accompanying drawings.

Figure 1:
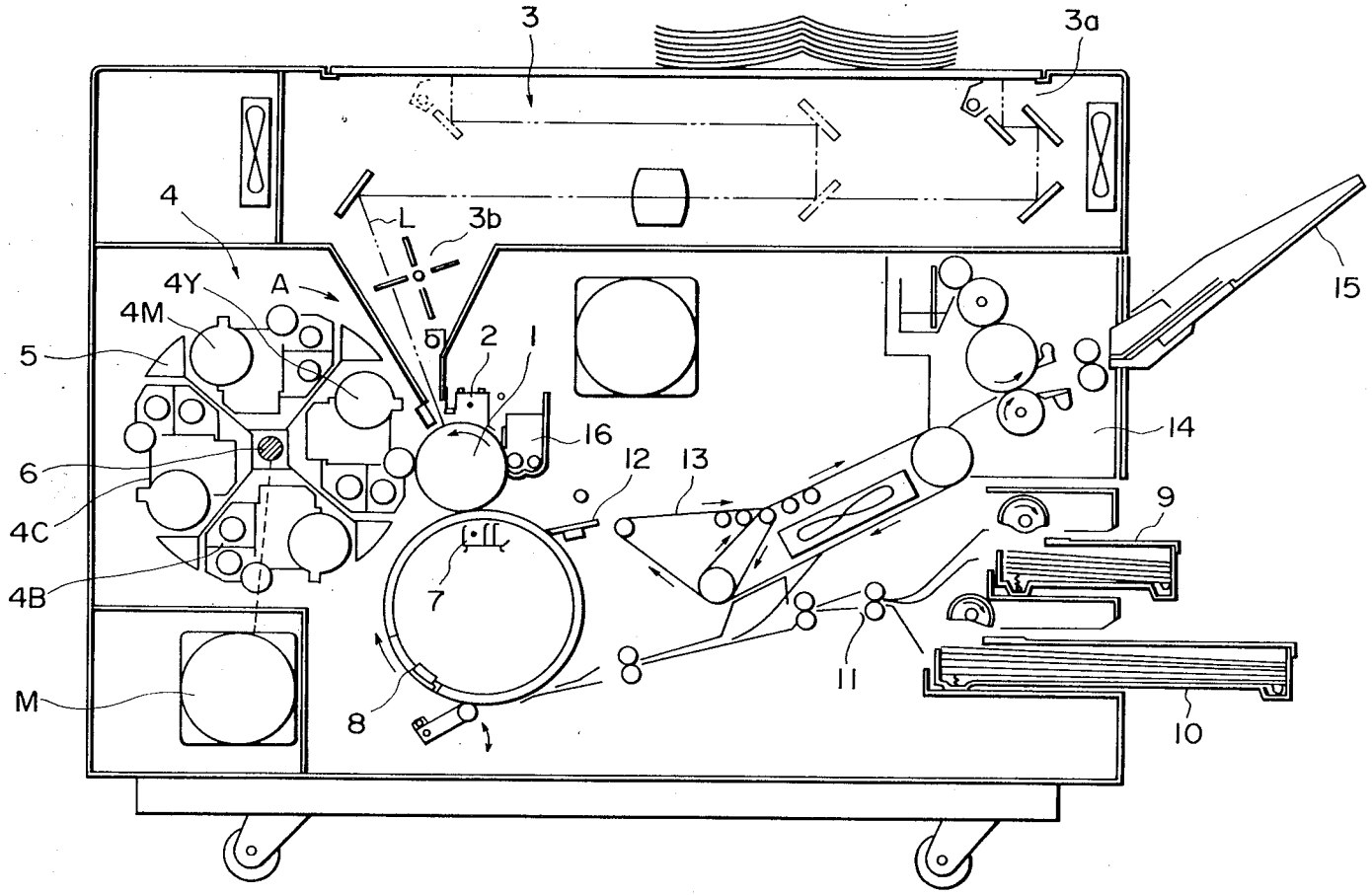
FIG. 1 is a cross-sectional view of an image forming apparatus usable with the present invention.

Referring to FIG. 1, there is shown an electrophotographic copying machine as an image forming apparatus for producing a full-color image, to which the present invention is applicable.

The apparatus shown in this Figure comprises a photosensitive drum 1 as an image bearing member which rotates in a direction shown by an arrow. The photosensitive drum 1 is uniformly charged by a corona discharger 2 and then exposed to a color-separated light image through an optical system 3 having a color-separating filter **3*b* and original scanning means 3*a*. By this exposure to the light image, the latent image is formed on the photosensitive drum 1, and it is developed by the developer assembly, which includes a yellow toner developing device 4Y, a magenta toner developing device 4M, a cyan toner developing device 4C and a black toner developing device 4B. Each of those developing devices is provided with a developing opening through which it acts on the photosensitive member to develop the latent image thereon. The developing devices are supported on a supporting member or turret 5 so that the openings are equidistant from the center of the supporting member 5. The supporting member 5 is driven by a motor M to rotate about a shaft 6 at the center of the supporting member 5** in a direction shown by an arrow A. By this rotation, the developing devices revolve so that a required one of the developing devices containing the required color toner can be moved to a developing station, corresponding to the color of the color-separated image.

Then, the toner image resulting from the development of the latent image on the photosensitive drum 1 is transferred onto a transfer material which has been supplied on a transfer drum 8, by a known image transfer means, such as a corona discharger, and this is repeated on the same transfer material to superpose the images of different colors thereon. The apparatus further comprises cassettes 9 and 10 for accommodating the transfer material and a registration roller 11 for supplying the transfer material to the transfer drum 8 in alignment with the toner image on the photosensitive drum 1. The transfer material having received the toner image is separated from the transfer drum 8 by a separating pawl 12, and then conveyed by a conveying belt 13 to a fixing device 14 where the toner image is fixed on the transfer material. Subsequently, the transfer material is discharged out of the apparatus. The apparatus is further provided with a cleaning member for removing the toner remaining on the photosensitive drum 1 after the image transfer.

Description will be made with respect to a developing assembly 4 according to an embodiment of the present invention.

Figure 2:
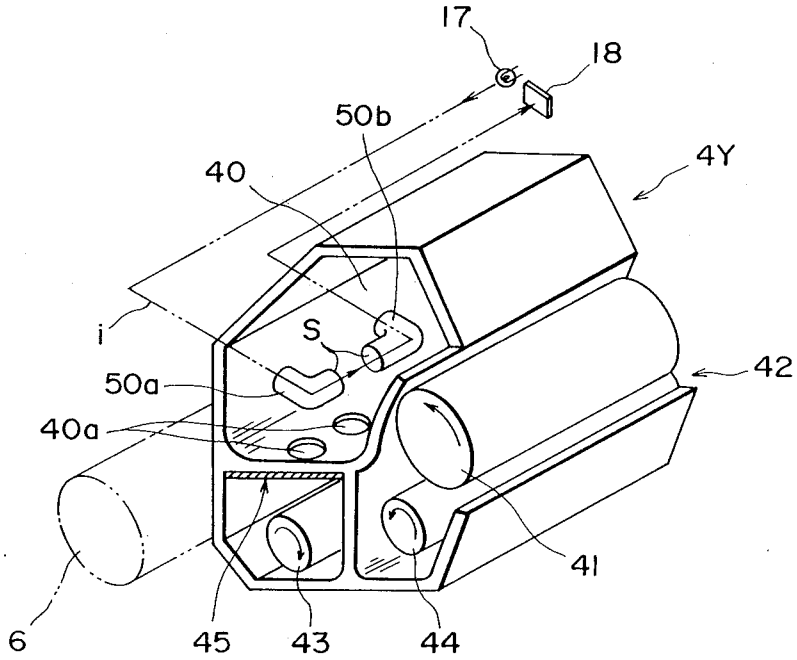
FIG. 2 is a partly broken perspective view of a developing apparatus.

FIG. 2 is a perspective view of the developing device 4Y. The developing device 4Y includes a developer container 40 for accommodating the developer and a rotatable developing roller 41 for applying the developer to the latent image on the photosensitive drum 1. The developing roller 41 is provided adjacent the developing opening of the developing device 4Y so as to be partly exposed outside through the opening 42 to be accessible to the photosensitive drum. The developing roller 41 may have a rotatable sleeve of a non-magnetic material and a magnet member therein, for example. The developing device 4Y further includes a known conveying screw roller 43 and 44 for conveying the developer supplied from the developer container 40. The developer contained in the developer container 40 is supplied through an aperture 40*a*. The amount of the developer passing through the aperture 40*a* is controlled by a slidable shutter 45. In this example, the developer contains magnetic carrier particles and toner particles, that is, the developer in this example is a two component developer.

In the developer container 40, the toner particles to be supplied are accommodated. The toner supplied from the developer container 40 is circulated in the developing device 4Y by the conveying screw rollers 43 and 44 while being stirred with the magnetic carrier particles. The magnetic carrier particles and the toner particles thus stirred and mixed together are attracted to and carried on the developing roller 42 by the magnetic force exerted by the magnetic member of the developing roller 42. The developer is not limited to the two component developer, but it is possible to use one component developer consisting of the toner only.

Since the developer is retained on the developing roller 41 by the magnetic field provided by the magnet member thereof, the developer hardly leaks out of the developing opening 42.

In the developer container 40 of the developing device, two detecting elements 50*a* and 50*b* are provided to detect the remaining amount of the toner to be supplied. Those detecting elements 50*a* and 50*b* are disposed along the inner wall surface of the container 40. The detecting elements 50*a* and 50*b* have detecting surfaces S which are opposed to one another, the detecting surfaces S being generally perpendicular to the rotational shaft 6. The surfaces S are spaced with a predetermined clearance. More detailed explanation will be made as to the location of those elements.

A light source 17 is fixed in the image forming apparatus and emits light i which is introduced to a detecting element 50*a* through an unshown light transmitting member, such as optical fiber or fibers. The light i reaches the detecting surface of the other detecting element 50*b* through the clearance between the detecting surfaces S. The light i received by the detecting element 50*b* reaches a light receiving element 18 fixed in the image forming apparatus through an unshown light transmitting member. Thus, the detecting elements 50*a* and 50*b* constitute a part of the light transmitting path extending from the light source 17 to the light receiving element 18.

The light source 17 and the light receiving element 18 may be provided in each of the developing devices rather than in the image forming apparatus.

In operation, when the developer container 40 contains ample toner, the toner exists between the detecting surfaces S of the detecting elements 50*a* and 50*b*, and therefore, the light i from the light source 17 hardly reaches the light receiving element 18. As the amount of the toner in the developer container 40 decreases with use, the amount of the toner existing between the detecting surfaces S becomes smaller, with the result that the light i from the light source 17 reaches the detecting element 50*b*, and therefore to the light receiving element 18. The amount of light received by the light receiving element 18 is converted to an electric signal or the like, and a warning is produced to indicate "no toner" when the amount of the light reaches a predetermined level.

The foregoing description of the developing device in conjunction with FIG. 2 has been made with respect to the developing device 4Y, but the same essentially applies to the other developing devices 4M, 4C and 4B.

Figure 3:
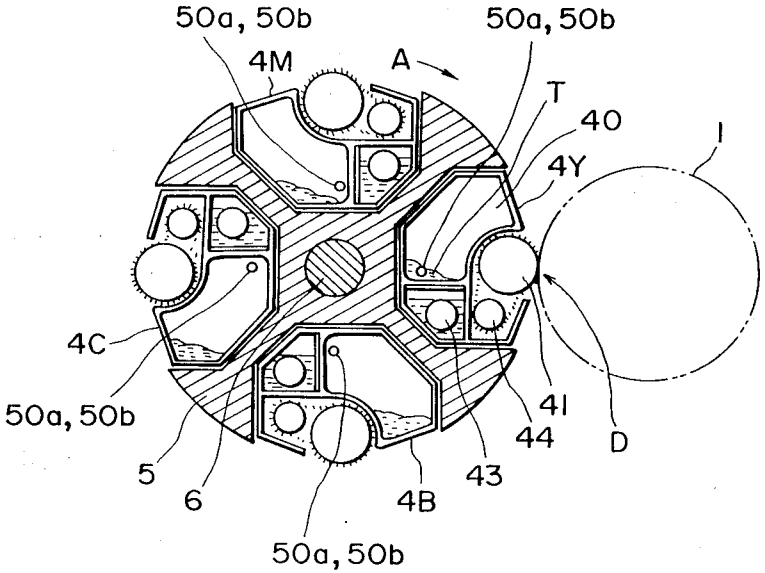
FIG. 3 is a cross-sectional view of a developer assembly to which all of the developing devices are mounted thereto.

FIG. 3 is a cross-sectional view of the developing assembly 4 having the supporting member 5 to which the developing devices 4Y, 4M, 4C and 4B are mounted. Each of the developing devices is fixedly or detachably mounted to the mounting member 5. The developing openings of the developing devices are arranged on one and the same phantom circle having its center coincident with the center of the shaft 6. The toner T in the container 40 is shown as having been consumed to a certain extent. The toner T in the container 40, when the supporting member 5 rotates in the direction of the arrow A, moves along the inner wall surface of the container 40. The path of the movement depends on the direction of gravity, but moves in the direction substantially perpendicular to the axes of the shaft 6 of the supporting member 5.

The locations of the detecting elements 50*a* and 50*b* will be described in detail in conjunction with FIG. 4. When the supporting member 5 rotates one full turn, for example, the toner T in the container 40 of the developing device 4Y moves along the inner wall surface of the container 40 as shown by an arrow B. In this embodiment, the detecting elements 50*a* and 50*b* are located at such a position that it is adjacent the bottom of the container 40 when the developing device is at a detecting position M and that it is upstream of the toner T with respect to movement of the toner T. In this embodiment, the above mentioned detecting position is the position which is taken by the developing device when it is located at the developing station D shown in FIG. 3. In other words, the state of the developer is detected when the developing device is at the developing position D.

When the amount of toner remaining in the container is small, the toner tends to accumulate adjacent the corner R of the container due to the attracting forces existing between the particles, e.g., Coulomb force and electrostatic attracting forces resulting from triboelectric charging. It is desirable, therefore, to dispose the detecting elements at the above described position M.

If the supporting member 5 is rotatable in the direction opposite to the direction of arrow A, the movement of the toner is in the opposite direction to that shown by the arrow B. In this case, the detecting elements are disposed at a position N shown by the broken lines.

As described, it is preferable that when the supporting member is rotatable in such a direction that during the rotation a bottom part of the container 40 is leading as compared with the remaining part of the container 40

(clockwise in FIGS. 3 and 4), the detecting means is disposed at the position M adjacent the bottom part of the container and adjacent an inner wall surface of the container 40 nearer to the rotational axis of the supporting member.

On the other hand, it is preferable when the supporting member is rotatable in such a direction that during the rotation thereof a bottom part of the container 40 is trailing as compared with the remaining part thereof (counterclockwise in FIGS. 3 and 4), the detecting means is disposed at the position N adjacent the bottom of the container and adjacent an inner wall surface remote from the rotational axis of the supporting member.

Figure 5:
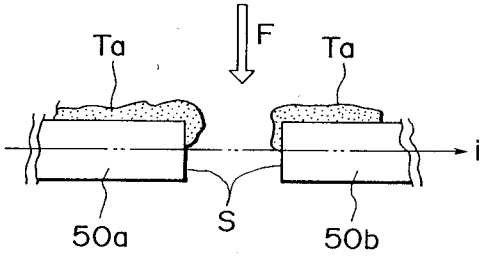
FIG. 5 illustrates operation of cleaning of the detecting means.

In any case, by disposing the detecting elements at such a position described above, the toner T falls or flows through the clearance between the detecting surfaces S of the detecting elements 50*a* and 50*b* at least once, when the supporting member 5 rotates one full turn. The toner moving this way rubs and cleans the detecting surfaces S of the detecting elements 50*a* and 50*b*. As shown in FIG. 5, when the toner T is once attached and accumulated on a part of the detecting elements 50*a* and 50*b*, the toner particles suspended in the container 40 tend to be collected to the accumulated toner Ta by the forces existing among the particles, and therefore, the toner attached to the detecting elements increases, without our invention. However, according to this embodiment of the present invention, with the rotation of the supporting member 5, the toner particles within the container 40 move as described above to go into the clearance between the detecting surfaces S of the detecting elements 50*a* and 50*b* as shown by an arrow F, and strike the toner Ta attached to the surfaces. This striking action is effective to remove the toner particles from the detecting surfaces S and therefore to clean them. Since the detecting elements are located in the corner adjacent to the bottom of the container 40, the detecting surfaces S are sufficiently rubbed and cleaned by the toner particles even when the remaining amount of the toner becomes small. Therefore, the possibility of erroneous detection is effectively removed which may otherwise be caused by the toner attached to the detecting surfaces S of the detecting elements.

In this embodiment, the detection of the remained amount of the toner is carried out when the developing device is at the developing station D shown in FIG. 3. Because of this, when the supporting member 5 rotates in the direction of the arrow A, the detecting surfaces S of the detecting elements 50*a* and 50*b* are cleaned by the moving toner particles immediately before the detecting position, and therefore, the possibility of the erroneous detection is more effectively removed.

Figure 4:
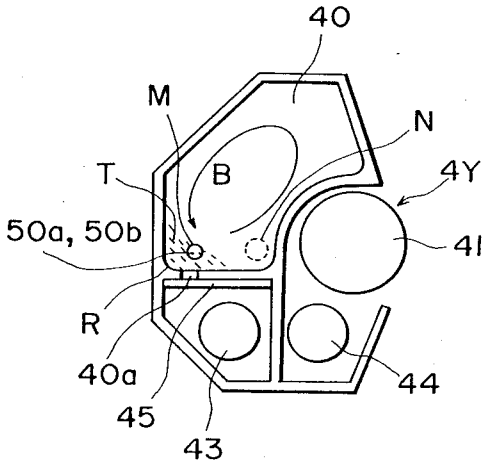
FIG. 4 illustrates locations of detecting means and movement of toner in the developing device.

In order to use the toner efficiently, it is preferable that the toner supply aperture 40*a* is located at such a position as shown in FIG. 4, and the shutter member 45 is slidden in response to the developer concentration signal. Further, it is preferable to round at least the corner R adjacent to the detecting elements 50*a* and 50*b* of the container 40 to provide a smoother movement of the toner T.

Figure 7:
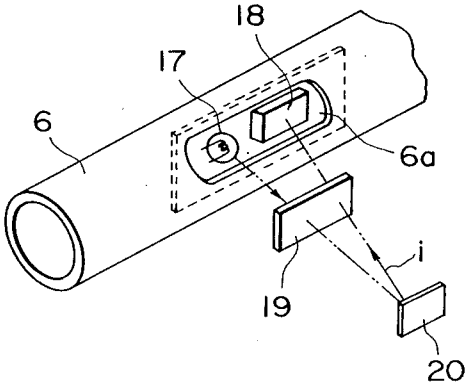
FIG. 7 is a perspective view of a main part of the detecting means shown in FIG. 6.
Figure 6:
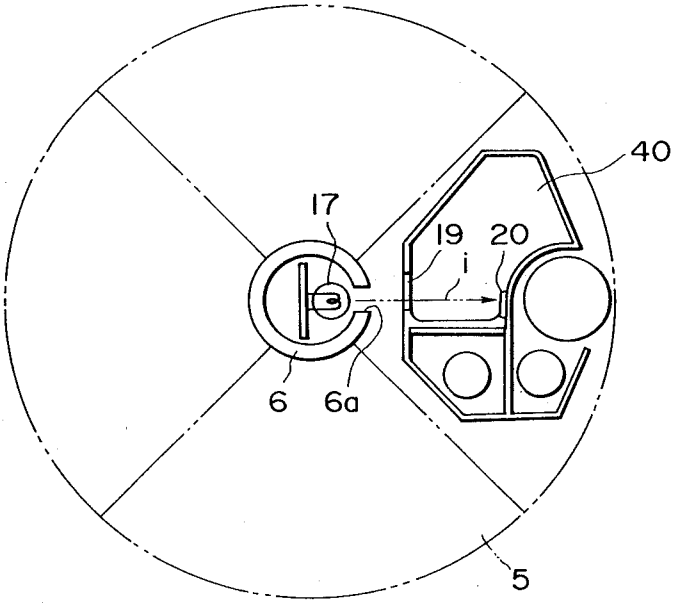
FIG. 6 illustrates detecting means according to another embodiment of the present invention.

FIGS. 6 and 7 show another example of the detecting means, wherein the shaft 6 of the supporting member 5 is hollow and is provided with an opening in its circumferential periphery. A light source 17 and a light receiving element 18 of the type described above are located in the hollow shaft 6 adjacent the opening 6*a*. Each of the developing devices is provided with a transparent plate 19 and a reflecting plate 20 opposed to the transparent plate 19 disposed adjacent to the bottom of the toner container 40 when it takes the toner detecting position. The transparent plate 19 and the reflecting plate 20 are flush with or projecting from the inner wall surface of the container 40. Each of them is integrally supported on the container 40. Therefore, when the supporting member 5 rotates, the toner T moves along the inner wall surface of the container 40 while rubbing the surfaces of the transparent plate 19 and the reflecting plate 20, so that the possibility of the toner particles being attached thereto is reduced.

According to this embodiment, the light source 17 and the light receiving element 18 are provided within the shaft 6 so that the light transmitting member used in the first embodiment is not necessary, whereby the structure is simplified.

Assuming that the position shown in FIG. 6 is the detecting position, the light source 17 and the light receiving element 18 may be fixed at the positions shown, and one light source and one light receiving element are sufficient to detect the remaining amount of the toner in all of the developing devices by making the developing devices revolvable about the stationary hollow shaft.

The light source and the light receiving element provided within the hollow shaft are applicable to the above described first embodiment.

In the description of the embodiments, what is detected by the detecting means is the remaining amount of the toner to be supplied. This is not limiting, but when the developer consists of the toner and the carrier, the ratio of the toner and the carrier, in other words, the concentration of the developer may be detected. In addition, particularly when the developer consisting only of the toner, the remaining amount of the toner in the container is detected.

The foregoing description of the embodiment has been made with respect to the detecting means utilizing light, but the other detecting means are usable, for example, the ones utilizing the permeability of the developer and the ones utilizing the vibration of a piezoelectric element or the like.

The image to be developed by the developing apparatus of the present invention is not limited to an electrostatic latent image but may be a magnetic latent image.

As described above, according to the present invention, the detecting means has the detecting surfaces located within the region where the developer moves in the container. Because of this, the detecting surfaces are cleaned constantly by the developer particles. Therefore, the erroneous detection can be prevented which may be caused by the developer particles attached to the detecting surface of the detecting means. Additionally, it is not necessary to use additional cleaning members or mechanism for driving the cleaning members, and thereore, the apparatus can be made smaller in size and lighter in weight with the advantage of simplified structure.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

a plurality of developing units each adapted to contain a developer of a selected color, said developing units each including a developer container for containing the developer and means for supplying the developer to a member to be developed;

supporting means for supporting the plurality of said developing units, said supporting means being rotatable to move a selected one of said developing units to a predetermined developing station; and movable detecting means for detecting a state of the developer, said detecting means being novable together with rotation of said container by rotation of said supporting means, said detecting means being provided on an inside of said container at such a position that said detecting means is capable of moving across a volume of the developer within said container.

2. An apparatus according to claim 1, wherein said detecting means constitutes a part of a couple of optical elements having a light emitting surface and a light receiving surface, respectively, which are opposed to each other to form a detecting portion.

3. An apparatus according to claim 2, wherein the light emitting surface and the light receiving surface are generally perpendicular to an axis of rotation of said supporting means.

4. An apparatus according to claim 1, wherein said detecting means includes an optically transparent member and a reflecting member which are opposed and which constitute a part of the inner wall surface of said container.

5. An apparatus according to claim 4, wherein said supporting means includes a hollow shaft having an opening in the circumferential periphery thereof, and the hollow shaft contains therein a light emitting member and a light receiving member to be exposed through said opening, the light emitting member emitting light to the reflecting member through the optically transparent member opposed to said reflecting member.

6. An apparatus according to claim 2, wherein said supporting means is rotatable in such a direction that during the rotation a bottom part of said container is leading as compared with the remaining part thereof, and said detecting means is disposed adjacent the bottom part of the container and adjacent an inner wall surface of said container nearer to a rotational axis of said supporting means.

7. An apparatus according to claim 2, wherein said supporting means is rotatable in such a direction that during the rotation thereof a bottom part of said container is trailing as compared with the remaining part thereof, and said detecting means is disposed adjacent the bottom of the container and adjacent an inner wall surface remote from a rotational axis of said supporting means.

8. An apparatus according to claim 1, wherein each of said developing units is provided with an opening through which said developer supplying means is exposed, and said openings of the developing units are equidistant from a rotational axis of said supporting means.

9. An apparatus according to claim 1, wherein said detecting means detects an amount of the developer remained in the container.

10. An apparatus according to claim 1, wherein said detecting means detects concentration of the developer.

11. An apparatus according to claim 1, wherein said detecting means has a detecting surface facing in a direction substantially perpendicular to an axis of rotation of said supporting means.

12. An apparatus according to claim 1, wherein said detecting means has a detecting surface facing in a direction substantially parallel to an axis of rotation of said supporting means.

13. An apparatus according to claim 1, wherein detecting operation using said detecting means is effected when the developing unit associated with said detecting means is in the developing station.

* * * * *